US009588531B2

(12) United States Patent
Pelicia et al.

(10) Patent No.: US 9,588,531 B2
(45) Date of Patent: Mar. 7, 2017

(54) VOLTAGE REGULATOR WITH EXTENDED MINIMUM TO MAXIMUM LOAD CURRENT RATIO

(71) Applicant: Freescale Semiconductor, Inc., Austin, TX (US)

(72) Inventors: Marcos M. Pelicia, Campinas (BR); Edevaldo Pereira Silva, Jr., Austin, TX (US)

(73) Assignee: NXP USA, Inc., Austin, TX (US)

( * ) Notice: Subject to any disclaimer, the term of this patent is extended or adjusted under 35 U.S.C. 154(b) by 11 days.

(21) Appl. No.: 14/714,256

(22) Filed: May 16, 2015

(65) Prior Publication Data

US 2016/0334819 A1 Nov. 17, 2016

(51) Int. Cl.
*G05F 1/575* (2006.01)
*G05F 1/46* (2006.01)

(52) U.S. Cl.
CPC ..... *G05F 1/575* (2013.01)

(58) Field of Classification Search
CPC ..... G05F 1/575; G05F 1/465; G05F 1/462; G05F 1/467
See application file for complete search history.

(56) References Cited

U.S. PATENT DOCUMENTS 6,040,736 A * 3/2000 Milanesi ..... G05F 1/575 323/316
6,246,221 B1 * 6/2001 Xi ..... G05F 1/575 323/280
6,300,749 B1 10/2001 Castelli et al.
6,518,737 B1 2/2003 Stanescu et al.
6,703,815 B2 * 3/2004 Biagi ..... G05F 1/575 323/275
8,022,681 B2 * 9/2011 Gurcan ..... G05F 1/565 323/283
2008/0174289 A1 * 7/2008 Gurcan ..... G05F 1/575 323/280
2014/0191739 A1 * 7/2014 Kim ..... G05F 1/575 323/280
2015/0220096 A1 * 8/2015 Luff ..... G02F 1/1368 327/109
2016/0026199 A1 * 1/2016 El-Nozahi ..... G05F 1/575 323/274

OTHER PUBLICATIONS

Wong et al., "A 150mA Low Noise, High PSRR Low-Dropout Linear Regulator in 0.13 μm Technology for RF SoC Applications," IEEE Solid-State Circuits Conference, 2006, pp. 532-535.

* cited by examiner

*Primary Examiner* — Adolf Berhane
*Assistant Examiner* — Sisay G Tiku

(57) ABSTRACT

Voltage regulator with extended minimum to maximum current ratio. In some embodiments, a low-dropout (LDO) voltage regulator disposed within a semiconductor package may include an inner loop; and an outer loop coupled to the inner loop, wherein: the inner loop is configured to control a load response of the LDO voltage regulator and to reduce at least one of: a printed circuit board (PCB) effect on the outer loop, a packaging effect on the outer loop, or a parasitic effect on the outer loop; the outer loop is configured to control a voltage at an output of the LDO voltage regulator; the output of the LDO voltage regulator is coupled to an integrated circuit within the semiconductor package; and the PCB, package, and parasitic effects comprise inductive or resistive effects caused by elements disposed outside of the semiconductor package.

15 Claims, 4 Drawing Sheets

400

VOLTAGE REGULATOR WITH EXTENDED MINIMUM TO MAXIMUM LOAD CURRENT RATIO

FIELD

This disclosure relates generally to electronic circuits, and more specifically, to a voltage regulator circuit with extended minimum to maximum load current ratio.

BACKGROUND

A linear voltage regulator is an analog circuit capable of providing a stable output voltage from an unregulated supply to a load having specific current range. Linear voltage regulators have become an essential building block in modern electronics, as having a well-behaved supply voltage that is capable of responding to faster load transients is now a requirement for most systems.

Technical specifications for linear voltage regulators include, for example, the regulator's output voltage, which defines the nominal output voltage and the minimum and maximum output values of the regulator subject to load variations ("transient response"). Other specifications include the regulator's dropout voltage, which is the minimum difference needed between the input and output voltages for the regulator to be able to still produce a regulated output, and the regulator's maximum and minimum load current capability.

A low-dropout (LDO) voltage regulator is a particular type of voltage regulator with improved dropout voltage characteristics. Particularly, a conventional LDO voltage regulator includes: (1) a series pass device (e.g., a power Field Effect Transistor or "FET") coupled between the LDO's unregulated input and its regulated output; and (2) a high gain error amplifier that controls the drop voltage of the pass device by comparing the output voltage with an accurate reference voltage (e.g., a bandgap reference voltage). A resistor divider may also be used to scale the output voltage to match the reference voltage and to allow regulated voltages higher than the reference.

Conventional high current LDOs usually also include a bypass capacitor to achieve transient response requirements. As a consequence, high current LDOs further require a minimum load current to guarantee stability of its control loop.

The inventors hereof have recognized that lowering the minimum load current capability requirement of high current LDOs is desirable in many scenarios. One such scenario appears in the context of battery supply systems, where battery life is dependent upon the system's current consumption. In order to save battery charge, only basic features are kept on during operation. Hence, the ratio of current load (ratio of maximum and minimum load current) tends to increase, and fast transient response is required for switching between different operation modes. However, a typical LDO presents strong loss of transient performance due to loss of bandwidth at light load conditions.

The inventors hereof have also recognized that the bypass capacitor within the LDO represents a significant bill of material cost, and therefore it would be desirable to at least reduce those costs. Generally speaking, high value capacitors (over 10 uF) are expensive because they employ special materials in their construction. However, reducing the capacitance of the bypass capacitor requires a faster regulator transient response that can overcome Printed Circuit Board (PCB), semiconductor packaging, and/or other parasitic effects. These parasitic effects play an important role in the stabilization of LDOs, particularly under high loads conditions.

To address these, and other problems with conventional LDOs, the inventors hereof have developed a voltage regulator circuit with extended minimum to maximum current ratio. In various embodiments, the systems and methods described herein provide a solution that improves the performance of the LDOs and result in a better transient performance even in the presence of significant parasitics.

BRIEF DESCRIPTION OF THE DRAWINGS

The present invention(s) is/are illustrated by way of example and is/are not limited by the accompanying figures, in which like references indicate similar elements. Elements in the figures are illustrated for simplicity and clarity and have not necessarily been drawn to scale.

DETAILED DESCRIPTION

Electronic devices may include a power supply and one or more packaged integrated circuits (ICs) coupled to the power supply. Each IC may include a voltage regulator configured to provide a stable static and dynamic supply voltage to at least a portion of the IC within a specified range of load currents.

A decoupling capacitor (referred herein as C or $C_{load}$) is typically added at the output of a conventional LDO voltage regulator to keep the supply voltage relatively constant within the specified load current range in the presence of load changes that the LDO voltage regulator would otherwise not be fast enough to provide. One of the goals of providing a faster LDO voltage regulator, as discussed below, is to allow a reduction or minimization in the value of $C_{load}$, thus reducing costs and semiconductor footprint. Left unchecked, however, a typical LDO presents strong loss of transient performance due to loss of bandwidth at light load conditions, and $C_{load}$ reduction also contributes to this undesirable characteristic. In addition, light load conditions create a minimum current load specification.

Due in part to the conventional use of high value coupling capacitors and relatively limited operating speed, traditional LDO designs have not taken into account effects caused by elements disposed outside of the packaged IC, such as Printed Circuit Board (PCB) effects, semiconductor or packaging effects, and/or other parasitic effects. When reducing the decoupling capacitance, however, these effects begin to play an important role in the transient performance and in the stabilization of LDOs, particularly at high load conditions.

Therefore, to address these and other problems, embodiments of an LDO voltage regulator design described herein takes into account resistive and inductive effects caused by components disposed outside of the IC's package and compensates for those effects independent of load conditions. As such, the systems and methods described below may in some cases extend a minimum to maximum current ratio of the LDO voltage regulator, particularly for smaller sized coupling capacitors. Moreover, a regulator circuit according to these embodiments does not present the drawbacks related to conventional circuits, which have a much smaller current ratio due to the parasitic features of those external components.

Figure 1:
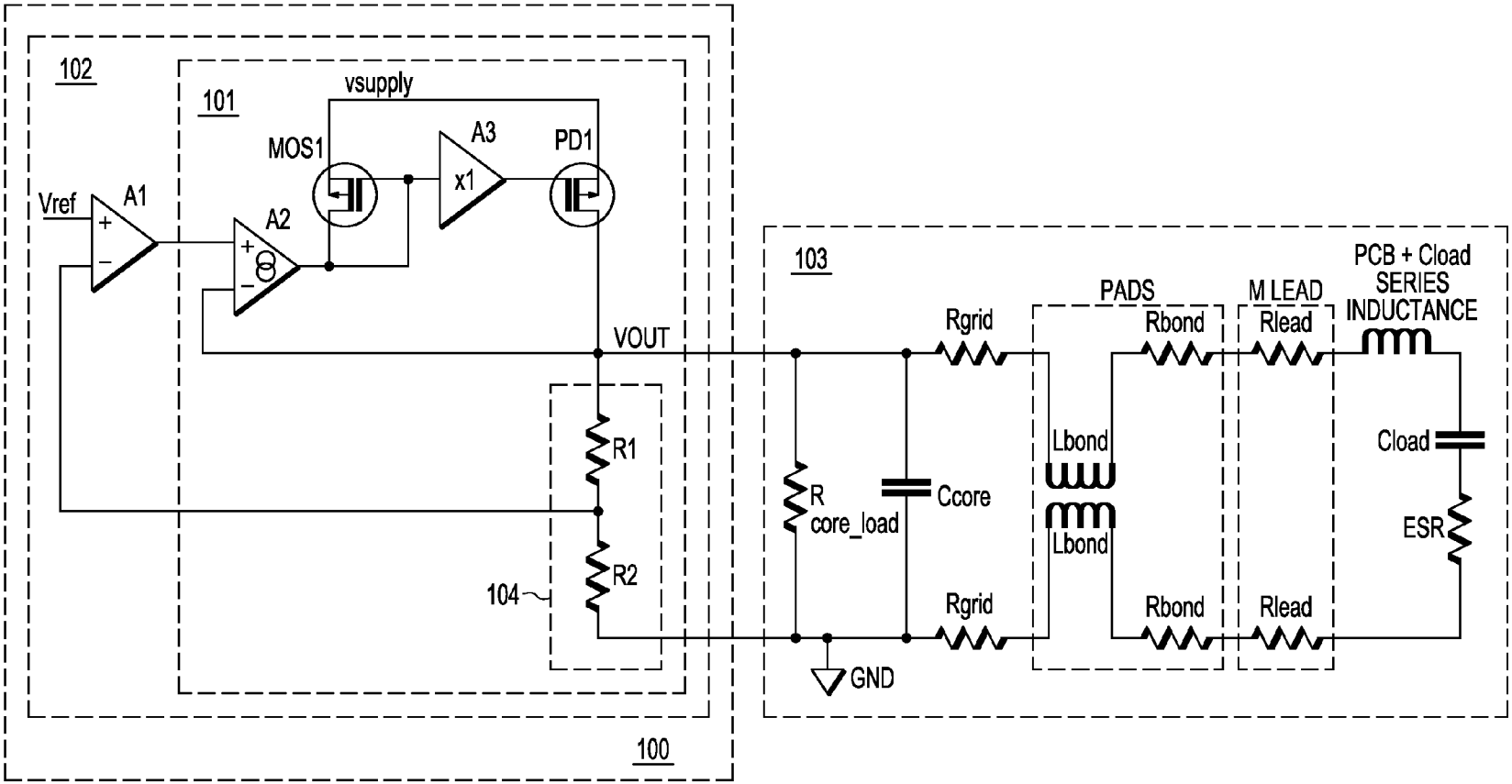
FIG. 1 is a high-level circuit diagram of an example of a low-dropout (LDO) voltage regulator with extended minimum to maximum current ratio according to some embodiments.

Turning to FIG. 1, a high-level circuit diagram of an example of LDO voltage regulator 100 with extended minimum to maximum current ratio is depicted. Particularly, the LDO voltage regulator includes inner loop 101 and outer loop 102. Components 103 illustrate resistive and inductive effects caused by components disposed outside of the ICs.

Examples of components 103 that may have a negative influence on the minimum to maximum current ratio of LDO voltage regulator 100 include $R_{CORE_LOAD}$ and $C_{CORE}$, internal power metal connection $R_{GRID}$, wire bonding inductance $L_{bond}$, wire bonding resistance $R_{bond}$, lead resistance $R_{lead}$, PCB net inductance plus load inductance of coupling or bypass capacitor C "PCB+$C_{load}$ series inductance," capacitance $C_{load}$ of capacitor C, and equivalent series resistance (ESR) of capacitor C. It should be noted, however, that in other implementations components 103 may vary, and that other parasitic components may be added to or removed from FIG. 1 without departing from the scope of these embodiments.

Inner loop 101 of LDO voltage regulator 100 is configured to control the load transient response of LDO voltage regulator 100. Inner loop 101 also reduces loading and parasitic influence on outer loop 102 caused by one or more components 103 disposed outside of the semiconductor package. Meanwhile, outer loop 102 is configured to control the steady state voltage output of the LDO voltage regulator. By decoupling speed and accuracy goals in the design of LDO voltage regulator 100, each loop can be optimized to achieve a specific goal; namely, inner loop 101 may be used to meet speed requirements whereas outer loop 102 addresses accuracy requirements.

As illustrated, comparator A1 of outer loop 102 receives a reference voltage (e.g., a bandgap voltage) at its non-inverting input, and a sample of the output voltage at a node between resistances R1 and R2—which form voltage divider 104—at its inverting input.

Comparator A1 has its output coupled to the non-inverting input of operational transconductance amplifier (OTA) A2, which is used as the input of inner loop 101. At this point, inner loop 101 may be observed by outer loop 102 as a unitary gain buffer with a single pole frequency response (or another suitable type of buffer in other designs), not contributing with a significant phase shift in the operating frequency band of external loop 102.

Inner loop 101 includes OTA A2 and P-type metal-oxide-semiconductor (PMOS) transistor MOS1 with drain and gate terminals connected to the output terminal of A2, thus creating a load current dependent DC gain subsystem. Generally speaking, this subsystem is configured to reduce bandwidth dependence of LDO voltage regulator 100 on a load current.

Inner loop 101 also includes an open loop, input/output rail-to-rail buffer A3 (e.g., a unitary gain buffer) having its input coupled to the output of OTA A2 through transistor MOS1, and its output coupled to the gate terminal of PMOS pass device PD1. In operation, A3 isolates A2's response from the influence of Pass Device PD1's gate terminal characteristics. In addition, by using A3, a specified transient response can be achieved with optimized power consumption.

Still referring to inner loop 101, MOS 1 has its source terminal coupled to vsupply, its drain terminal coupled to the output of A2, and its gate terminal coupled to the input of A3. Pass device PD1 has its source terminal coupled to vsupply, and its drain terminal coupled to voltage divider 104 and to the "vout" node (between PD1 and R1), which provides the regulator 100's output.

Due to the presence of inner loop 101 and its unitary gain buffer characteristics, outer loop 102 may be simplified. Even with parasitic effects within a wide frequency range and a wide load variation, LDO voltage regulator 100 operates as a compensated two-pole system. Moreover, bandwidth is selected by adjusting the inner loop 101's bandwidth, such that load transients are rejected at the linear frequency range of inner loop 101. The bandwidth of outer loop 102 may be made to match the bandwidth of inner loop 101. As a consequence, the transient response becomes load and parasitic independent within the specified range.

Figure 2:
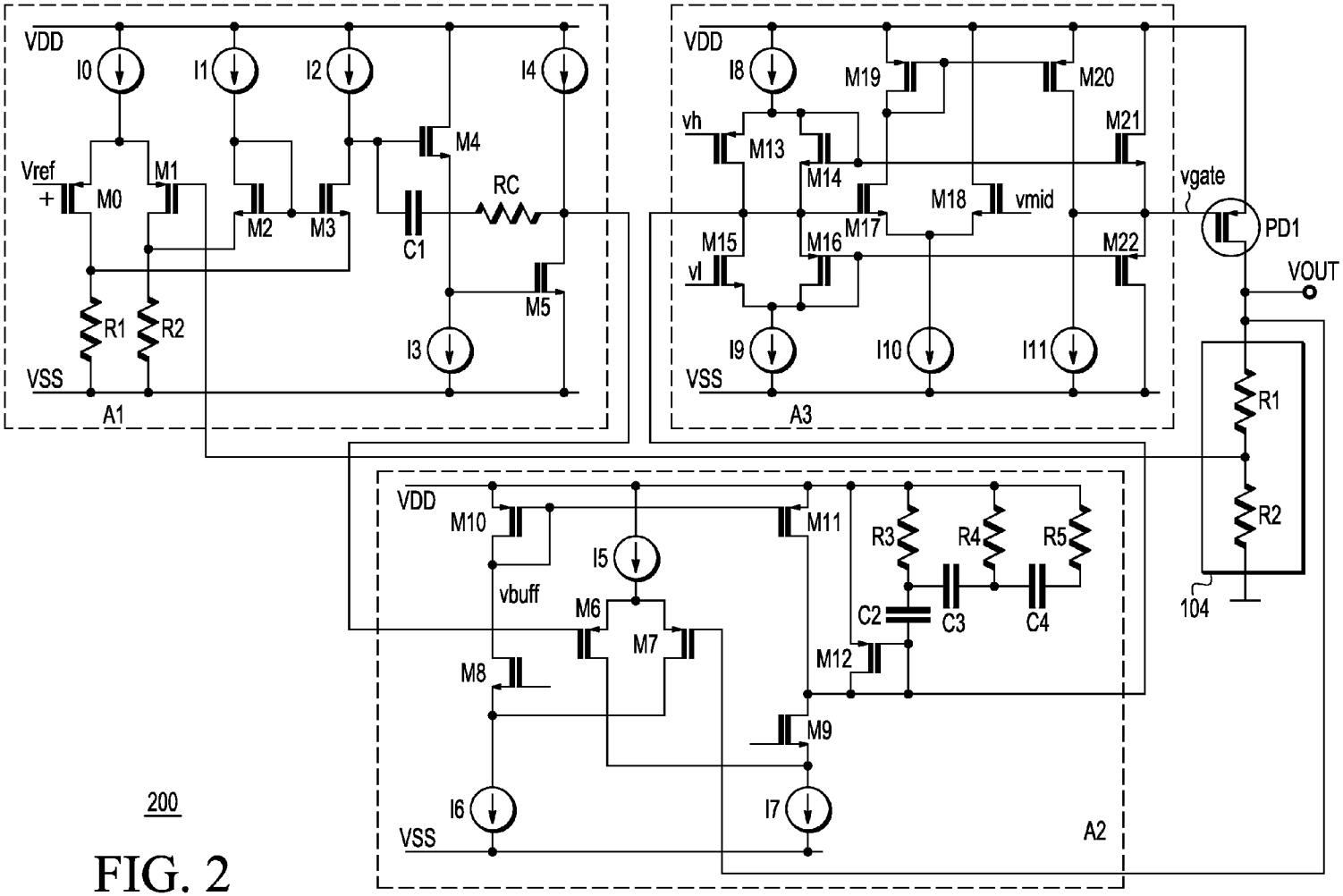
FIG. 2 is a circuit diagram of an illustrative implementation of an LDO voltage regulator according to some embodiments.

FIG. 2 is a circuit diagram of an illustrative implementation 200 of LDO voltage regulator 100 depicted in FIG. 1, according to some embodiments. Each of comparator A1, OTA A2, and buffer A3 operate with VDD and VSS as their upper and lower (e.g., a reference or ground node) voltage rails. Particularly, comparator A1 includes current sources I0-I4, PMOS transistors M0-M5, capacitor C1, and resistors R1, R2, and Rc coupled as shown. Reference voltage Vref and the node between resistances Rf1 and Rf2 that samples output voltage are coupled to the gate terminals of M0 and M1, respectively. The output of A1 (Vbuff) is provided to OTA A2.

OTA A2 includes current sources 15-17, PMOS transistors M10-M12, NMOS transistors M6-M9, capacitors C2-C4, and resistors R3-R5 configured as shown. PMOS transistor M12 operates as a tracking pole diode, and elements C2-C4 and R3-R5 operate as a filter array to allow A2 to be tuned to a particular frequency range in a way that compensates for undesirable parasitic effects of other components outside of LDO voltage regulator 100, for example of components disposed outside of a package of a semiconductor chip where regulator 100 is fabricated.

Still referring to A2, the gate terminal of PMOS transistor M6 receives Vbuff from A1, and the gate terminal of PMOS transistor M7 receives Vout from the output node of LDO voltage regulator 100 between PD1 and R1. M6 and M7 produce on their drain terminals complementary currents proportional to the input voltage difference. The sum of these complementary currents is the I5 current source value.

Within OTA A2, the circuit formed by transistors M6-M11 produce, between the drain terminals of M11 and M9, an electrical current that has a value dependent upon a voltage difference between the gate terminals of transistors M6 and M7. Transistors M6, M8, M10, and M11 produce an electrical current dependent upon a voltage at the gate of M6, while transistors M7 and M9 produce an electrical current dependent upon a voltage at the gate of M7. A difference between currents at the node between the drain terminals of M11 and M9 is applied to the gate terminal of M12.

Tracking pole diode M12 is configured to compensate the LDO's gain variations due to load variations. The filter array is configured to maintain a consistent frequency response under influence of one or more components disposed outside of the semiconductor package by preventing the frequency response of the LDO to be severely affected by those components.

In sum, M12 may have characteristics and properties similar to those of Pass Device PD1. As such, M12 operates to provide pole tracking by compensating for gain variations due to changes in load. Conversely, the filter array acts upon the frequency response of LDO regulator 100 to make it more consistent and stable around the frequency band of parasitic effects, hence forcing a drop in voltage gains outside that band and reducing even further the influence of parasitic, external components. In other implementations, tracking pole diode M12 and/or other filter(s) may be placed in another portion(s) of inner loop 101.

Unitary gain buffer A3, having MOS1 of in FIG. 1 built into it, includes current sources I8-I11 and PMOS transistors M13, M16, and M21, as well as N-type MOS (NMOS) transistors M14, M15, M17-M19, M25, and M22 configured as shown. The high voltage boundary Vh, low voltage boundary VI, and a mid voltage boundary Vmid are determined to guarantee rail-to-rail low impedance characteristics to Unitary gain buffer A3 with a open loop configuration. The source terminal of M21 provides Vgate to the gate terminal of Pass Device PD1, and the output of inner loop 101 is provided to OTA A2. The voltage at the node between R1 and R2 is also provided to A2.

Figure 3:
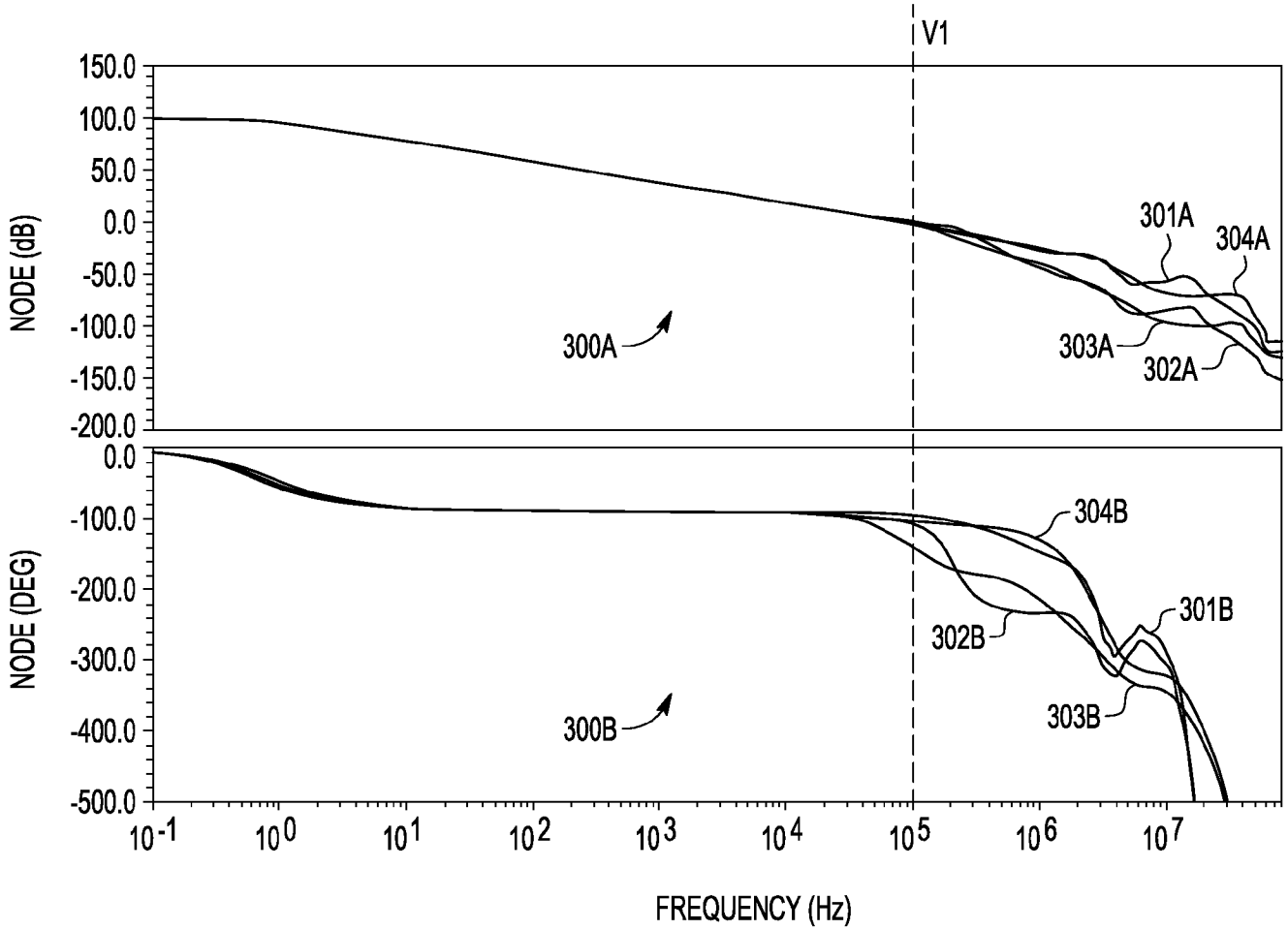
FIG. 3 shows graphs illustrating aspects of the operation of an LDO voltage regulator according to some embodiments.

FIG. 3 shows graphs illustrating aspects of the operation of the LDO voltage regulator according to some embodiments, more particularly the regulator overall open loop frequency response (Gain and phase charts). The overall open loop response is obtained by opening the outer loop 102 and keeps the inner loop 101 closed. The frequency response is analyzed in a combination of 4 different conditions: maximum and minimum specified current (ratio between minimum and maximum current is 320), as well as the best and worst case of external parasitics.

Particularly, in graph 300A, curve 301A shows an LDO voltage regulator's gain chart with maximum load and parasitic conditions, curve 302A shows the regulator's gain chart with minimum load and maximum parasitic conditions, curve 303A shows the regulator's gain chart with minimum load and parasitic conditions, and curve 304A shows the regulator's gain chart with maximum load and minimum parasitic conditions. Meanwhile, in graph 300B, curve 301B shows the LDO voltage regulator's phase chart with maximum load and parasitic conditions, curve 302B shows the regulator's phase chart with minimum load and maximum parasitic conditions, curve 303B shows the regulator's phase chart with minimum load and parasitic conditions, and curve 304B shows the regulator's phase chart with maximum load and minimum parasitic conditions.

Typical requirements for voltage regulators include that the phase response not shift more than 180 degrees while the gain response is higher than 0 dB. In chart 300A, it may be noted all the gain charts cross 0 dB at approximately the same frequency, indicated by vertical bar V1, which means that there is no difference on regulator gain response independently of load and parasitic conditions. Also, at the V1 frequency point, all of the phase plots on curve 300B present a shift lower than 180 degrees. That is, the system behaves the same way with light and heavy loads, and the load step response is enhanced as a consequence.

Figure 4:
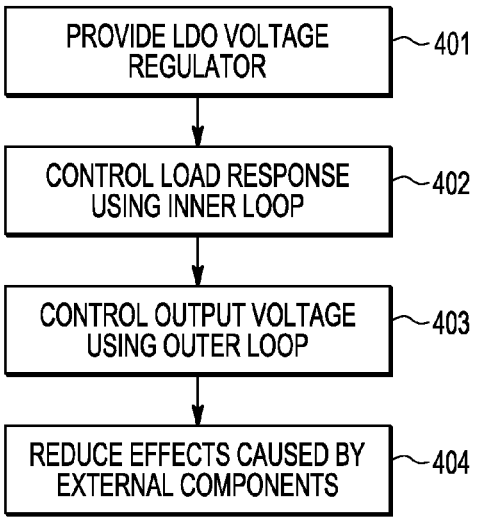
FIG. 4 is a flowchart of an example of a method of operation of an LDO voltage regulator according to some embodiments.

FIG. 4 is a flowchart of an example of a method of operation 400 of an LDO voltage regulator according to some embodiments. At block 401, method 400 includes providing LDO voltage regulator (e.g., 100) within a semiconductor chip. At block 402, method 400 includes controlling, via an inner loop (e.g., 101), a load response of the LDO voltage regulator. At block 403, method 400 includes controlling, via an outer loop (e.g., 102) coupled to the inner loop, a voltage at an output of the LDO voltage regulator. Then, at least in part by operation of blocks 402 and 403, block 404 reduces an electrical effect caused by one or more components disposed outside of the semiconductor chip.

In many implementations, the systems and methods disclosed herein may be incorporated into a wide range of electronic devices including, for example, computer systems or Information Technology (IT) products such as servers, desktops, laptops, memories, switches, routers, etc.; telecommunications hardware; consumer devices or appliances such as mobile phones, tablets, television sets, cameras, sound systems, etc.; scientific instrumentation; industrial robotics; medical or laboratory electronics such as imaging, diagnostic, or therapeutic equipment, etc.; transportation vehicles such as automobiles, buses, trucks, trains, watercraft, aircraft, etc.; military equipment, etc. More generally, these systems and methods may be incorporated into any device or system having one or more electronic parts or components.

Figure 5:
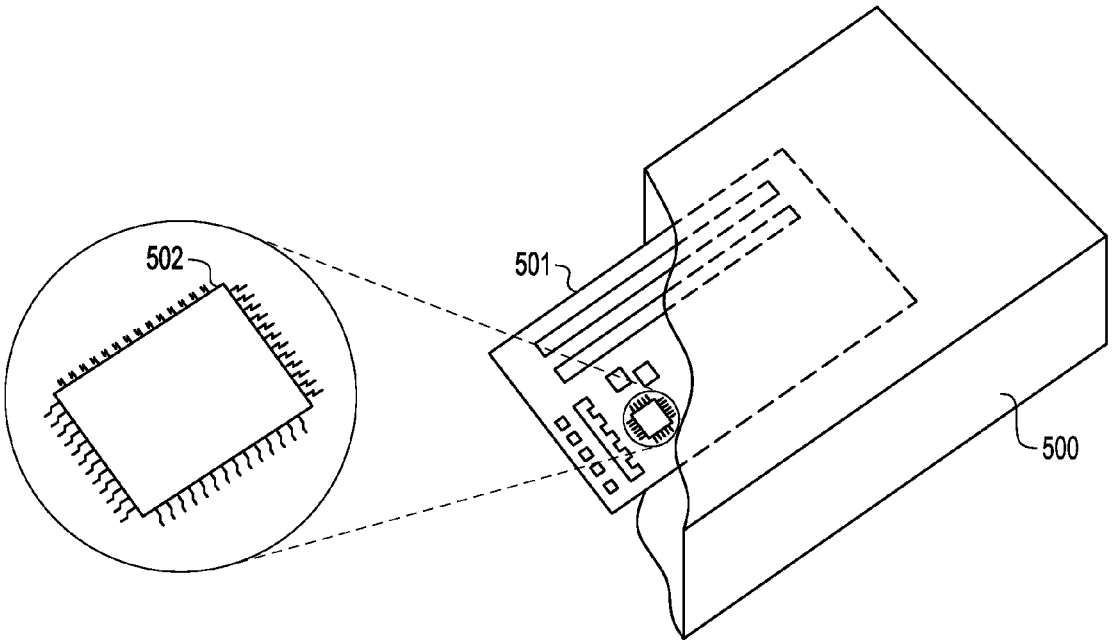
FIG. 5 is a diagram of an example of an electronic system having one or more electronic microelectronic device packages according to some embodiments.

Turning to FIG. 5, a block diagram of electronic system 500 is depicted. In some embodiments, electronic system 500 may include of the aforementioned electronic devices, or any other electronic device. As illustrated, electronic system 500 includes one or more Printed Circuit Boards (PCBs) 501, and at least one of PCBs 501 includes one or more microelectronic device package(s) 502. In some implementations, device package(s) 502 may include one or more circuits having a rail-to-rail source follower as discussed above.

Examples of device package(s) 502 may include, for instance, a System-On-Chip (SoC), an Application Specific Integrated Circuit (ASIC), a Digital Signal Processor (DSP), a Field-Programmable Gate Array (FPGA), a processor, a microprocessor, a controller, a microcontroller (MCU), a Graphics Processing Unit (GPU), or the like. Additionally or alternatively, device package(s) 502 may include a memory circuit or device such as, for example, a Random Access Memory (RAM), a Static RAM (SRAM), a Magnetoresistive RAM (MRAM), a Nonvolatile RAM (NVRAM, such as "FLASH" memory, etc.), and/or a Dynamic RAM (DRAM) such as Synchronous DRAM (SDRAM), a Double Data Rate RAM, an Erasable Programmable ROM (EPROM), an Electrically Erasable Programmable ROM (EEPROM), etc. Additionally or alternatively, device package(s) 502 may include one or more mixed-signal or analog circuits, such as, for example, Analog-to-Digital Converter (ADCs), Digital-to-Analog Converter (DACs), Phased Locked Loop (PLLs), oscillators, filters, amplifiers, etc. Additionally or alternatively, device package(s) 502 may include one or more Micro-ElectroMechanical Systems (MEMS), Nano-ElectroMechanical Systems (NEMS), or the like.

Generally speaking, device package(s) 502 may be configured to be mounted onto PCB 501 using any suitable packaging technology such as, for example, Ball Grid Array (BGA) packaging or the like. In some applications, PCB 501 may be mechanically mounted within or fastened onto electronic device 500. It should be noted that, in certain implementations, PCB 501 may take a variety of forms and/or may include a plurality of other elements or components in addition to device package(s) 502. It should also be noted that, in some embodiments, PCB 501 may not be used and/or device package(s) 502 may assume any other suitable form(s).

As described above, in an illustrative, non-limiting embodiment, an LDO voltage regulator disposed within a semiconductor package may include an inner loop; and an outer loop coupled to the inner loop, where: the inner loop is configured to control a load response of the LDO voltage regulator and to reduce at least one of: a PCB effect on the outer loop, a packaging effect on the outer loop, or a parasitic effect on the outer loop; the outer loop is configured to control a voltage at an output of the LDO voltage regulator; the output of the LDO voltage regulator is coupled to an integrated circuit within the semiconductor package; and the PCB, package, and parasitic effects comprise inductive or resistive effects caused by elements disposed outside of the semiconductor package.

The inner loop may include an operational transconductance amplifier (OTA) circuit having a load current dependent DC gain. The OTA circuit may be configured to reduce bandwidth dependence on a load current. For example, the OTA circuit may include an OTA; a tracking pole diode coupled to the OTA, wherein the tracking pole diode is configured to compensate gain variations due to load changes at the output of the OTA circuit; and a filter array coupled to the tracking pole diode, where the filter array is configured to maintain a consistent frequency response under influence of the at least one of the PCB, packaging, or parasitic effect.

The inner loop may be observed by the outer loop as a buffer with a single pole frequency response. The inner loop may further comprise a buffer having its input coupled to an output of the OTA circuit, the buffer having its output coupled to a gate terminal of a PMOS pass device. The buffer may be configured to provide a selected transient response with reduced power consumption. The inner loop may further comprise a feedback voltage divider coupled to a drain terminal of the PMOS pass device. The outer loop may comprise a comparator, where the comparator is configured to receive a reference voltage at its non-inverting input, where the comparator is configured to receive an output of the feedback voltage divider at its inverting input, and where the comparator is configured to provide its output to a non-inverting input of the OTA circuit.

In another illustrative, non-limiting embodiment, an electronic device may include a DC power source; an integrated circuit disposed within a semiconductor package; and a low-dropout (LDO) voltage regulator within the semiconductor package and configured to couple the power source to integrated circuit, the LDO voltage regulator further comprising: an inner loop; and an outer loop coupled to the inner loop, where the inner loop is configured to control a load response of the LDO voltage regulator and to reduce an electrical effect caused by one or more components disposed outside of the semiconductor package, and where the outer loop is configured to control a voltage at an output of the LDO voltage regulator.

In yet another illustrative, non-limiting embodiment, in an LDO voltage regulator disposed within a semiconductor package, a method may include controlling, via an inner loop, a load response of the LDO voltage regulator to reduce an electrical effect caused by one or more components disposed outside of the semiconductor package; and controlling, via an outer loop coupled to the inner loop, a voltage at an output of the LDO voltage regulator.

Although the invention(s) is/are described herein with reference to specific embodiments, various modifications and changes can be made without departing from the scope of the present invention(s), as set forth in the claims below. Accordingly, the specification and figures are to be regarded in an illustrative rather than a restrictive sense, and all such modifications are intended to be included within the scope of the present invention(s). Any benefits, advantages, or solutions to problems that are described herein with regard to specific embodiments are not intended to be construed as a critical, required, or essential feature or element of any or all the claims.

Unless stated otherwise, terms such as "first" and "second" are used to arbitrarily distinguish between the elements such terms describe. Thus, these terms are not necessarily intended to indicate temporal or other prioritization of such elements. The term "coupled" is defined as connected, although not necessarily directly, and not necessarily mechanically. The terms "a" and "an" are defined as one or more unless stated otherwise. The terms "comprise" and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a system, device, or apparatus that "comprises," "has," "includes" or "contains" one or more elements possesses those one or more elements but is not limited to possessing only those one or more elements. Similarly, a method or process that "comprises," "has," "includes" or "contains" one or more operations possesses those one or more operations but is not limited to possessing only those one or more operations.

The invention claimed is:

1. A low-dropout (LDO) voltage regulator disposed within a semiconductor package, the LDO voltage regulator comprising:

an inner loop; and an outer loop coupled to the inner loop, wherein:

the inner loop is configured to control a load response of the LDO voltage regulator and to reduce at least one of: a printed circuit board (PCB) effect on the outer loop, a packaging effect on the outer loop, or a parasitic effect on the outer loop, wherein the inner loop comprises an operational transconductance amplifier (OTA) circuit having a load current dependent DC gain, and wherein the OTA circuit comprises:

an OTA;

a tracking pole diode coupled to the OTA, wherein the tracking pole diode is configured to compensate gain variations due to load changes at the output of the OTA circuit; and a filter array coupled in parallel with the tracking pole diode, wherein the filter array is configured to maintain a consistent frequency response under influence of the at least one of the PCB, packaging, or parasitic effect, and wherein the tracking pole diode has: (a) its source terminal coupled to a first terminal of the filter array, and (b) its gate terminal coupled to its drain terminal and to a second terminal of the filter array;

the outer loop is configured to control a voltage at an output of the LDO voltage regulator;

the output of the LDO voltage regulator is coupled to an integrated circuit within the semiconductor package; and the PCB, package, and parasitic effects comprise inductive or resistive effects caused by elements disposed outside of the semiconductor package.

2. The LDO voltage regulator of claim 1, wherein the OTA circuit is configured to reduce bandwidth dependence on a load current.

3. The LDO voltage regulator of claim 1, wherein the inner loop is observed by the outer loop as a buffer with a single pole frequency response.

4. The LDO voltage regulator of claim 1, wherein the inner loop further comprises a buffer having its input coupled to an output of the OTA circuit, the buffer having its output coupled to a gate terminal of a P-type metal-oxide-semiconductor (PMOS) pass device.

5. The LDO voltage regulator of claim 4, wherein the buffer is configured to provide a selected transient response with reduced power consumption.

6. The LDO voltage regulator of claim 4, wherein the inner loop further comprises a feedback voltage divider coupled to a drain terminal of the PMOS pass device.

7. The LDO voltage regulator of claim 6, wherein the outer loop comprises a comparator, wherein the comparator is configured to receive a reference voltage at its non-inverting input, wherein the comparator is configured to receive an output of the feedback voltage divider at its inverting input, and wherein the comparator is configured to provide its output to a non-inverting input of the OTA circuit.

8. An electronic device comprising: a DC power source;

an integrated circuit disposed within a semiconductor package; and a low-dropout (LDO) voltage regulator within the semiconductor package and configured to couple the power source to integrated circuit, the LDO voltage regulator further comprising:

an inner loop, comprising: an operational transconductance amplifier (OTA);

a tracking pole diode coupled to the OTA; and a filter array coupled in parallel with the tracking pole diode, wherein the tracking pole diode has: (a) its source terminal coupled to a first terminal of the filter array, and (b) its gate terminal coupled to its drain terminal and to a second terminal of the filter array; and an outer loop coupled to the inner loop, wherein the inner loop is configured to control a load response of the LDO voltage regulator and to reduce an electrical effect caused by one or more components disposed outside of the semiconductor package, and wherein the outer loop is configured to control a voltage at an output of the LDO voltage regulator.

9. The electronic device of claim 8, wherein the OTA circuit is configured to reduce bandwidth dependence on a load current.

10. The electronic device of claim 8, wherein the inner loop is observed by the outer loop as a unitary gain buffer with a single pole frequency response.

11. The electronic device of claim 8, wherein the inner loop further comprises a buffer having its input coupled to an output of the OTA circuit, the buffer having its output coupled to a gate terminal of a P-type metal-oxide-semiconductor (PMOS) pass device.

12. The electronic device of claim 11, wherein the buffer is configured to provide a selected transient response with reduced power consumption.

13. The electronic device of claim 11, wherein the inner loop further comprises a feedback voltage divider coupled to a drain terminal of the PMOS pass device.

14. The electronic device of claim 13, wherein the outer loop comprises a comparator, wherein the comparator is configured to receive a reference voltage at its non-inverting input, wherein the comparator is configured to receive an output of the feedback voltage divider at its inverting input, and wherein the comparator is configured to provide its output to a non-inverting input of the OTA circuit.

15. In a low-dropout (LDO) voltage regulator disposed within a semiconductor package, a method comprising:

controlling, via an inner loop, a load response of the LDO voltage regulator to reduce an electrical effect caused by one or more components disposed outside of the semiconductor package; and controlling, via an outer loop coupled to the inner loop, a voltage at an output of the LDO voltage regulator, wherein the inner loop comprises an operational transconductance amplifier (OTA) circuit having a load current dependent DC gain, wherein the OTA circuit comprises: (a) an OTA; (b) a tracking pole diode coupled to the OTA, wherein the tracking pole diode is configured to compensate gain variations due to load changes at the output of the OTA circuit; and (c) a filter array coupled to the tracking pole diode, wherein the filter array is configured to maintain a consistent frequency response under influence of the one or more components disposed outside of the semiconductor package, wherein the tracking pole diode has: (i) its source terminal coupled to a first terminal of the filter array, and (ii) its gate terminal coupled to its drain terminal and to a second terminal of the filter array, wherein the inner loop comprises a buffer having its input coupled to an output of the OTA circuit, the buffer having its output coupled to a gate terminal of a P-type metal-oxide-semiconductor (PMOS) pass device, wherein the inner loop further comprises a feedback voltage divider coupled to a drain terminal of the PMOS pass device, wherein the outer loop comprises a comparator, wherein the comparator is configured to receive a reference voltage at its non-inverting input, wherein the comparator is configured to receive an output of the feedback voltage divider at its inverting input, and wherein the comparator is configured to provide its output to a non-inverting input of the OTA circuit.

* * * * *